US007798736B2

(12) United States Patent
Hoarau et al.

(10) Patent No.: US 7,798,736 B2
(45) Date of Patent: Sep. 21, 2010

(54) MEDIA BINDER ARRANGEMENTS

(75) Inventors: Eric Hoarau, Palo Alto, CA (US); Steven W. Trovinger, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 229 days.

(21) Appl. No.: 11/490,687

(22) Filed: Jul. 21, 2006

(65) Prior Publication Data

US 2008/0018089 A1 Jan. 24, 2008

(51) Int. Cl.

| | |
|---|---|
| ***B42F 3/00*** | (2006.01) |
| ***B42F 13/12*** | (2006.01) |
| ***B42F 13/00*** | (2006.01) |
| ***B42F 1/06*** | (2006.01) |
| ***B42F 1/08*** | (2006.01) |
| ***B42F 1/02*** | (2006.01) |
| ***A44B 1/04*** | (2006.01) |
| ***A44B 11/25*** | (2006.01) |
| ***A44B 17/00*** | (2006.01) |
| ***A41F 1/00*** | (2006.01) |
| ***A41F 1/08*** | (2006.01) |

(52) U.S. Cl. ..... 402/70; 402/73; 24/555; 24/563; 24/67.9

(58) Field of Classification Search ..... 281/21.1, 281/15.1; 402/70, 73, 500, 502; 24/67.9, 24/545, 555, 563, 456; 412/31

See application file for complete search history.

(56) References Cited

U.S. PATENT DOCUMENTS

| | | | | |
|---|---|---|---|---|
| 475,425 | A | 5/1892 | Vawter | |
| 560,353 | A * | 5/1896 | Haarvig | 24/67.5 |
| 1,741,909 | A * | 12/1929 | Belohlavek | 24/67.11 |
| 1,949,625 | A * | 3/1934 | Ritzhaupt | 462/55 |
| 2,347,278 | A | 9/1941 | Pitt | |
| 3,957,287 | A * | 5/1976 | Hall et al. | 281/21.1 |
| 4,114,240 | A | 9/1978 | Nackenson | |
| 4,178,201 | A * | 12/1979 | Power et al. | 156/499 |
| 4,402,530 | A * | 9/1983 | Daguerre | 281/45 |
| 4,624,480 | A | 11/1986 | Marthaler et al. | |

(Continued)

FOREIGN PATENT DOCUMENTS

| | | |
|---|---|---|
| CA | 2050244 | 3/1992 |

(Continued)

OTHER PUBLICATIONS

"Fastback Hardcover Guide" et al., Powis Parker Inc., 9 pages, http://www.powis.com (downloaded May 2007).

(Continued)

*Primary Examiner*—Dana Ross
*Assistant Examiner*—Kyle Grabowski

(57) ABSTRACT

The present invention is directed to articles such as media binders. In an embodiment the media binder includes spine clamps for securing physical media where the spine clamps define an interior cavity for receiving the physical media; a datum stop for aligning the physical media, the datum stop disposed proximal to one end of the spine clamp; a tension sheet for transmitting an opening force to the spine clamp, the tension sheet affixed with the spine clamp; and a cover affixed with the tension sheet, the cover configured to open such that an opening force is applied to the spine clamp when the cover is opened from a first position to a second position.

39 Claims, 10 Drawing Sheets

U.S. PATENT DOCUMENTS

| | | | | | |
|---|---|---|---|---|---|
| 4,832,369 | A | * | 5/1989 | Johnson et al. | 281/18 |
| 4,832,371 | A | | 5/1989 | Mugnai | |
| 4,986,713 | A | | 1/1991 | Zoltner et al. | |
| 5,015,115 | A | * | 5/1991 | Mandolesi | 402/56 |
| 5,035,447 | A | | 7/1991 | Lolli | |
| 5,061,139 | A | | 10/1991 | Zoltner | |
| 5,066,182 | A | | 11/1991 | Stonebraker | |
| 5,156,419 | A | | 10/1992 | Minch | |
| 5,314,283 | A | | 5/1994 | Zoltner | |
| 5,330,229 | A | | 7/1994 | Zoltner | |
| 5,562,309 | A | | 10/1996 | Brink et al. | |
| 5,574,519 | A | | 11/1996 | Mancino et al. | |
| 5,685,530 | A | | 11/1997 | DeLise | |
| 5,697,131 | A | * | 12/1997 | Hunt et al. | 24/563 |
| 5,716,181 | A | | 2/1998 | Ebel | |
| 5,733,087 | A | * | 3/1998 | Gwyn | 412/8 |
| 5,873,601 | A | | 2/1999 | Peleman | |
| 5,938,241 | A | * | 8/1999 | Wilson | 281/36 |
| 5,941,569 | A | | 8/1999 | Solomons | |
| 5,944,353 | A | * | 8/1999 | Sato | 281/29 |
| 6,149,200 | A | * | 11/2000 | Lockhart | 281/29 |
| 6,155,763 | A | | 12/2000 | Parker | |
| 6,322,867 | B1 | | 11/2001 | Rush | |
| 6,340,178 | B1 | | 1/2002 | Nkanishi et al. | |
| 6,422,797 | B2 | * | 7/2002 | Pas | 412/33 |
| 6,428,260 | B1 | | 8/2002 | Parker | |
| 6,581,970 | B1 | | 6/2003 | Lein | |
| 6,599,073 | B1 | | 7/2003 | Hartwig | |
| 6,672,815 | B2 | | 1/2004 | Parker | |
| 6,685,415 | B2 | | 2/2004 | Rush | |
| 6,709,727 | B1 | | 3/2004 | Parker | |
| 6,726,423 | B2 | | 4/2004 | Hocking | |
| 6,746,050 | B2 | | 6/2004 | Peleman | |
| 6,764,242 | B1 | * | 7/2004 | Karten et al. | 402/73 |
| 7,153,076 | B2 | | 12/2006 | Parker | |
| 2006/0061085 | A1 | | 3/2006 | Peleman | |

FOREIGN PATENT DOCUMENTS

| | | | |
|---|---|---|---|
| FR | 792956 | | 4/1959 |
| FR | 1232493 | A | 10/1960 |
| GB | 620201 | | 3/1949 |
| GB | 620201 | A | 3/1949 |
| GB | 2145033 | | 3/1985 |
| GB | 21455033 | | 3/1985 |
| GB | 2266866 | | 11/1993 |
| GB | 2294903 | | 5/1996 |
| JP | 09-216477 | | 8/1997 |
| KR | 2006-0051403 | | 5/2006 |
| WO | 97172210 | | 5/1997 |
| WO | WO9717210 | | 5/1997 |
| WO | 03043834 | | 5/2003 |
| WO | WO03043834 | | 5/2003 |

OTHER PUBLICATIONS

"High Quality Presentation Covers" et al., Channelbind International Corp., 5 pages, http://www.channelbind.com (downloaded May 2007).

"Binding on demand," Unibind Corp., 2 pages, http://www.unibind.com/Basic/binding/steelbinding/photobook.html (downloaded May 2007).

* cited by examiner

MEDIA BINDER ARRANGEMENTS

FIELD OF THE INVENTION

The present invention relates to arrangements for binding physical media in a media binder and methods for making and using the same.

BACKGROUND

Imaging systems continue to experience technological advances resulting in increased popularity and use. Some of the technological advances include substantial improvements in digital image capture devices such as digital cameras, digital video cameras, and scanning devices in terms of quality, speed, and ease of use. Other advances include improvements in digital imaging devices such as inkjet printers, laser printers, and silver halide grade photo imaging apparatus in terms of resolution, quality, and ease of use. Further, as imaging system technology matures, lower costs may be realized, which may ease entry for average consumers purchasing imaging systems.

With increased popularity and use, users of imaging systems have experienced a commensurate growth in the volume of images captured. And although these images may be conveniently stored in a memory storage device, at least some users will prefer to store their images in a printed format. For those users, a convenient and easy-to-use binder may be desirable for storing physical media.

Photo albums, scrapbooks, and the like are well-known in the art. Many schemes of securing media in such examples have been utilized. For example, some photo albums provide a number of sleeves for receiving photographs and other flat media. Scrapbooks may be configured with a "sticky" page to which a photo or memento may be attached and which may then be covered with an acetate sheet. In still other examples, fixed size sleeves, screw posts, and such clamping devices may be utilized to secure photographs and other flat media.

However, at least one problem with some clamping devices is the inability to readily align media. Thus, a user must typically pre-align photos and other flat media before clamping. Pre-alignment, however, is made more difficult when clamping forces make opening a clamp unwieldy. In addition, tools may be necessary to assemble certain types of albums, such as screw post.

Therefore, easy-to-use media binder arrangements for securely clamping and aligning physical media are presented herein.

SUMMARY

The following presents a simplified summary of some embodiments with features of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

The present invention is directed to articles such as media binders. In an embodiment the media binder includes spine clamps for securing physical media where the spine clamps define an interior cavity for receiving the physical media; a datum stop for aligning the physical media, the datum stop disposed proximal to one end of the spine clamp; a tension sheet for transmitting an opening force to the spine clamp, the tension sheet affixed with the spine clamp; and a cover affixed with the tension sheet, the cover configured to open such that an opening force is applied to the spine clamp when the cover is opened from a first position to a second position. In some embodiments, the spine clamp includes: two opposing clamping edges disposed along a first axis; two planar clamp faces wherein each planar clamp face includes a first edge and a substantially parallel second edge and wherein each first edge is connected with each of the at least two opposing clamping edges; a clamp spring plate connected with and disposed along the second edges, wherein the clamp spring plate is configured to provide a preload force and a clamping force and wherein the at least one datum stop is integral to the clamp spring plate.

In other embodiments, the cover includes: a viewing port disposed within the front planar surface or the back planar surface for viewing the physical media; a latch for securing the cover against opening, the latch configured to removably secure the front planar surface with the back planar surface; a sleeve for receiving a flat object, the sleeve attached with the front planar surface or the back planar surface; and a number of alignment tabs for aligning the physical media.

DETAILED DESCRIPTION OF EMBODIMENTS OF THE INVENTION

The present invention will now be described in detail with reference to a few embodiments thereof as illustrated in the accompanying drawings. The drawings are not intended to depict every feature of actual embodiments nor relative dimensions of the depicted elements, and are not drawn to scale. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Figure 1:
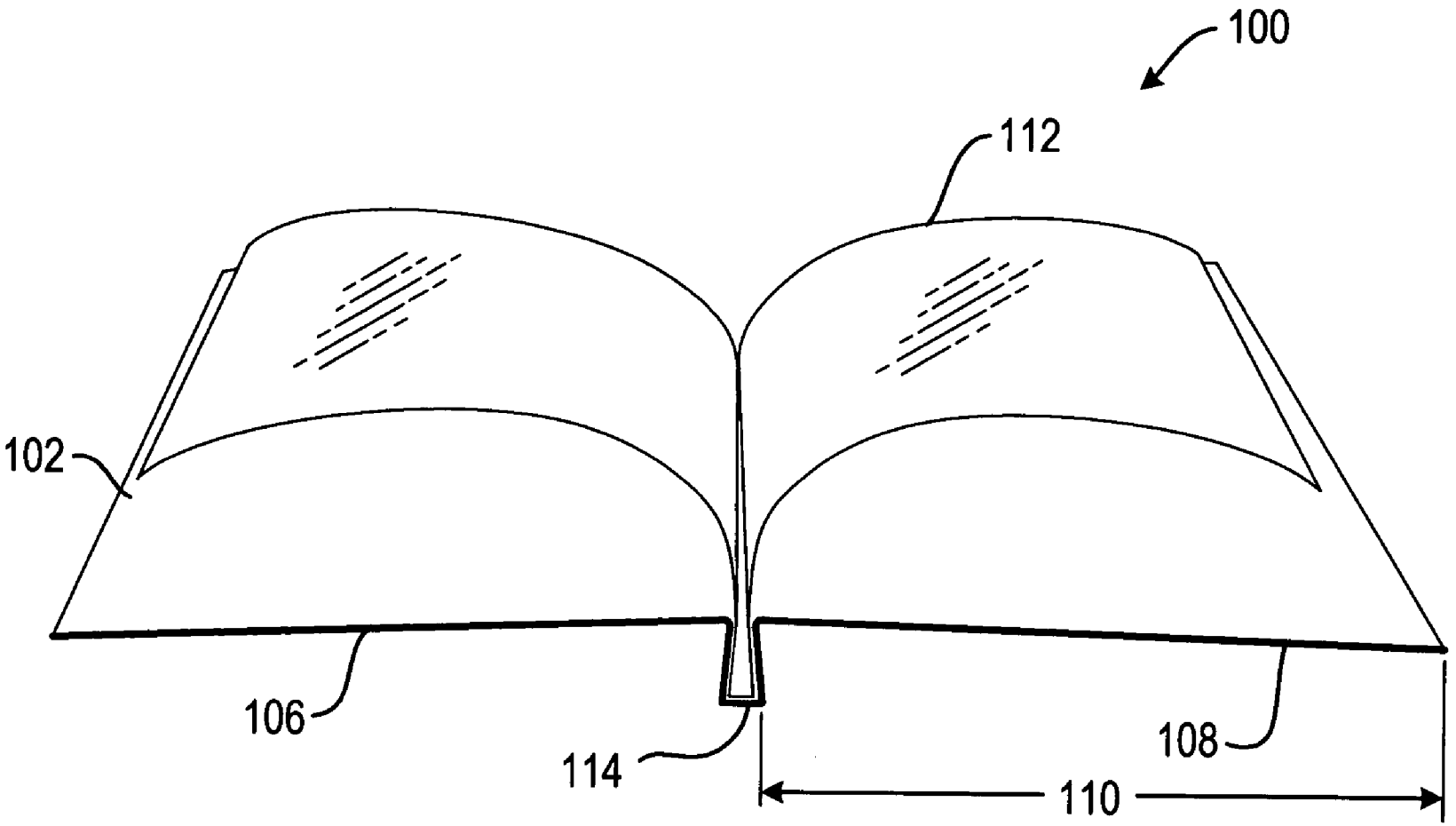
FIG. 1 is an illustrative representation of features of an opened media binder in accordance with an embodiment of the present invention.

FIG. 1 is an illustrative representation of an opened media binder 100 in accordance with an embodiment of the present invention showing features of the invention. In the illustrations, media binder 100 is opened on a flat surface, which is a typical viewing surface. In this position, media binder 100 is opened approximately 180° from a closed position. In this position, media 112 may be firmly secured in place while being viewed. Media binder 100 includes a cover 102 that includes a front planar surface 106, a spine planar surface 114, and a back planar surface 108. As noted above, spine clamps capable of securing a number of pages of media may be unwieldy to operate due to relatively strong clamping forces. As may be appreciated, a wide variety of physical media may be secured in embodiments described herein without departing from the present invention including, for example, photo paper, paper, card stock, business cards, fabric samples, carpet samples, synthetic membranes, acetate sheets, and the like. Furthermore, physical media may include any number of shapes and sizes without departing from the present invention. In embodiments disclosed herein, spine clamps may be opened when the cover 102 is opened over a specified range. Thus, the cover may be utilized to more easily overcome clamping forces and release secured media.

As one skilled in the art may appreciate, transverse dimension 110 enables a relatively large moment arm. In an embodiment, the moment ranges from 13:1 to 24:1, in part, depending on transverse dimension 110 of cover 102 (e.g., 6 or 11 inches). A relatively large moment arm enables a spine clamp to be relatively easily opened. In an embodiment, a spine clamp (such as that referenced as 210 in FIG. 2), may be configured with a preload force such that the media binder may remain closed when no media is secured. This feature may prevent media from being inadvertently captured by or entangled with the spine clamp. In addition, a spine clamp may be configured to provide a clamping force to accommodate one or more sheets or pages of the media such that the sheets or pages may be retained as the binder is being handled. In an embodiment, a spine clamp may be configured with a clamp spring plate that is configured such that a preload force of at least approximately 0.1 lbs. per linear inch of spine clamp is exerted on secured media. In other embodiments, a clamp spring plate is configured such that a clamping force is exerted that is preferably from approximately 2 to approximately 2.5 lbs. per linear inch of spine clamp, from approximately about 2.5 to approximately 3.5 lbs. per linear inch of spine clamp, from approximately 3.5 to approximately 4.5 lbs. per linear inch of spine clamp, or approximately greater than 4.5 lbs. per linear inch of spine clamp. Clamping force is the force exerted on secured media by the spine clamp. Clamp spring plates will be discussed in further detail below for FIG. 5.

Further, cover 102 may be configured to apply an opening force over a specified range of positions. Thus, in one embodiment, when cover 102 is opened from a first position greater than approximately 270° to a second position at approximately 360°, an opening force is applied to clamping structures thus releasing any secured media. Clamping structures will be discussed in further detail below. In one embodiment, the opening force is approximately in the range of 1 to 25 lbs.

Figure 2A:
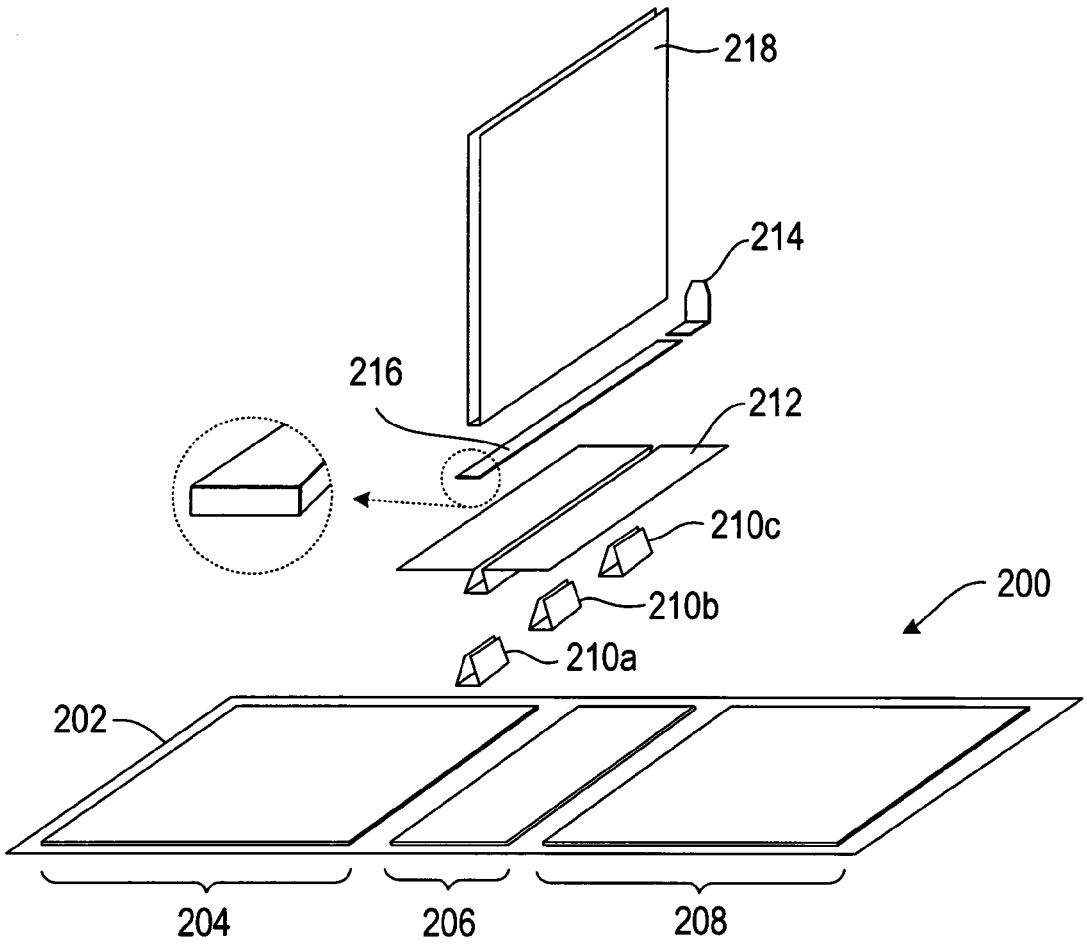
FIGS. 2*a-b* are illustrative representations of features of an exploded view of a media binder and an assembled view of a media binder in accordance with an embodiment of the present invention.

FIG. 2*a* is an illustrative representation of an exploded view of a media binder 200 in accordance with an embodiment of the present invention showing features of the invention. Media binder 200 includes a cover 202 that includes a front planar surface 204, a spine planar surface 206, and a back planar surface 208. Media binder 200 further includes one or more spine clamps 210*a*, 210*b*, and 210*c*. In one embodiment, two spine clamps may be utilized. In another embodiment, one spine clamp may be utilized. Embodiments utilizing single spine clamp configurations will be discussed in further detail below for FIGS. 4-5 showing features of the invention.

Media binder 200 further includes tension sheet 212. Tension sheet 212 operates to transmit an opening force to one or more spine clamps such as spine clamps 210*a*, 210*b*, and 210*c*. In order to transmit an opening force to one or more spine clamps, tension sheet 212 may be bonded to a spine clamp as well as to cover 202. When cover 202 is opened greater than 270°, an opening force is transmitted to one or more spine clamps such as spine clamps 210*a*, 210*b*, and 210*c* by the tension sheet 212. Tension sheets may be manufactured from a number of compositions including a substantially inelastic membrane, a substantially inelastic polymeric compound and a substantially inelastic fabric, or any other substantially inelastic composition without departing from the present invention.

Media binder 200 further includes datum stop 214. Datum stop 214 may be provided to easily align physical media being clamped. In one embodiment, a single datum stop may be utilized and disposed at either end of tension sheet. In other embodiments, two datum stops may be utilized and disposed at both ends of a tension sheet. In some embodiments, a datum spacer 216 may be utilized in coordination with datum stop 214. Datum spacer 216 may be co-planer with respect to datum stop 214. Datum spacer 216 may be utilized to limit the marginal width of physical media captured by clamping structures described herein, which may, in some embodiments result in a more aesthetically pleasing appearance. In one embodiment, the height of datum spacer 216 is approximately 1.5 mm. In other embodiments, the height of datum spacer 216 is less than 5 mm. In some embodiments, the datum stop may be affixed within the spine with or without the protective sheet. The datum stop, if a protective sheet is used, may be first attached to the protective sheet and then together inserted into the spine (with or without being affixed to the spine), or the protective sheet may be first be affixed to the spine followed by the datum stop being affixed thereafter.

In some embodiments, media binder 200 may optionally include protective sheet 218. In some embodiments, protective sheets include any number of mediums such as papers and films, or preferably, a translucent or transparent material such as an acetate, a polymeric film, or vellum without departing from the present invention. Protective sheet 218 may be utilized to protect secured physical media from inadvertent damage caused by opening and closing cover 202, and/or to protect exposed media against degradation due to natural elements (e.g., light and water). In some embodiments, a semi-transparent vellum may be utilized to provide ease of identifying a first secured physical medium. In other embodiments, protective sheet may include alignment tabs. Alignment tabs are discussed in further detail below for FIG. 10.

Figure 2B:
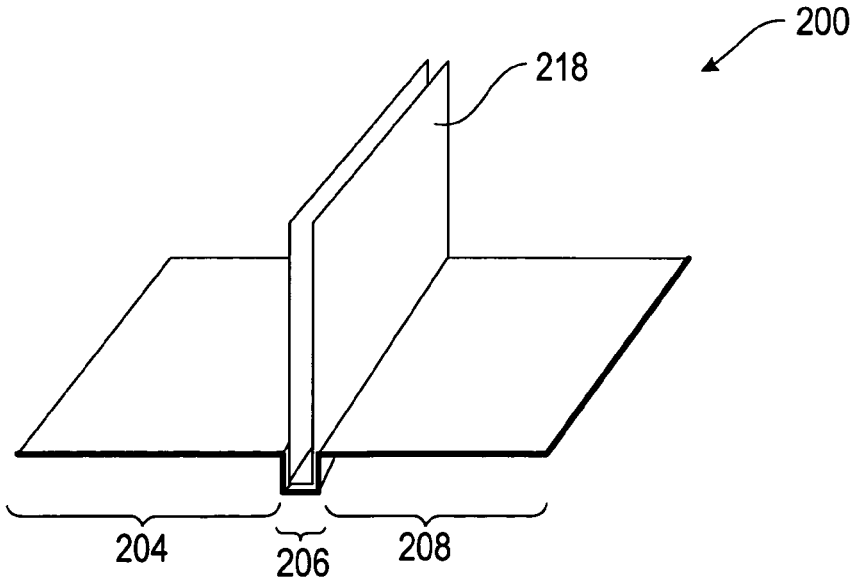

FIG. 2*b* is an illustrative representation of an assembled media binder 200, showing features of the invention, in accordance with an embodiment of the present invention. FIG. 2*b* is provided for clarity in understanding assembled embodiments of the present invention including embodiments described above for FIG. 2*a*.

Figure 3:
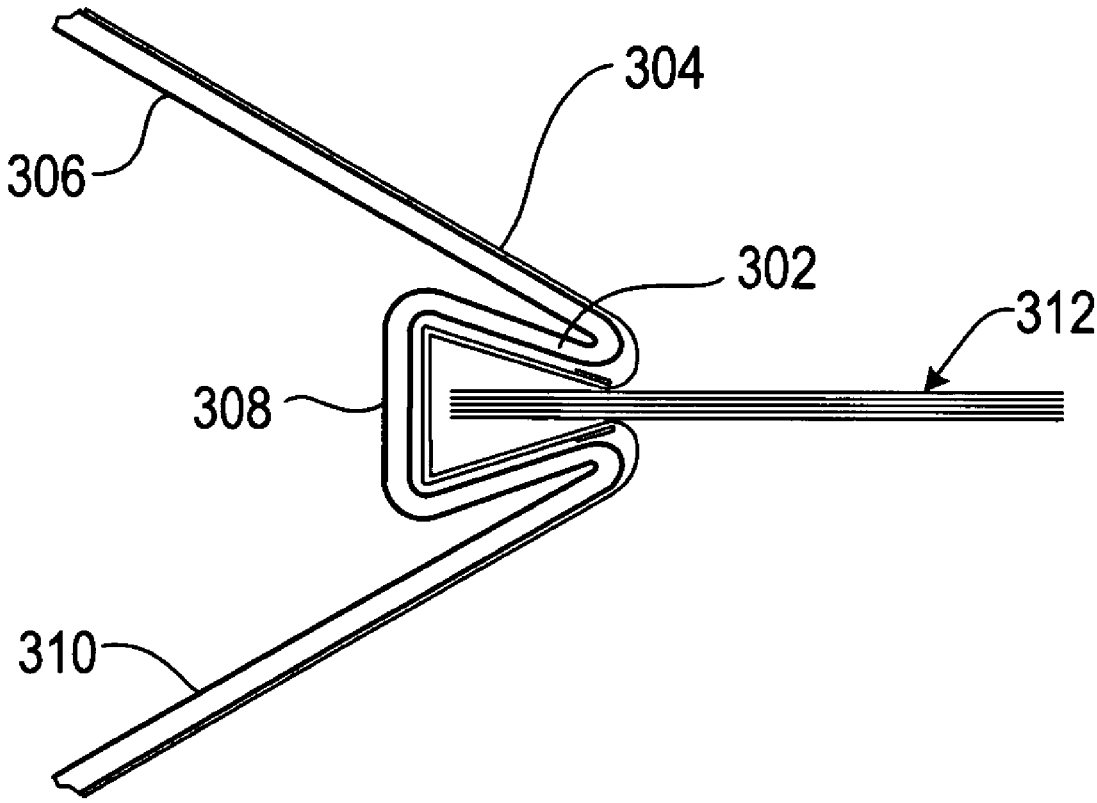
FIG. 3 is an illustrative cross-sectional representation of features of a portion of an open media binder in accordance with an embodiment of the present invention.

FIG. 3 is an illustrative cross-sectional representation of a portion of an open media binder, showing features of the invention, in accordance with an embodiment of the present invention. As illustrated, spine clamp 302 defines an interior cavity within which tension sheet 304 may be bonded and physical media 312 may be secured. Tension sheet 304 may be further bonded to front planar surface 306 and back planar surface 310. Because tension sheet 304 is bonded to those surfaces, an opening force may be transmitted to spine clamp 302 as described above. Spine planar surface 308 provides structural support for planar surfaces 306 and 310 as well as provides a covering for spine clamp 302. As may be appreciated, a wide variety of physical media may be secured in embodiments described herein without departing from the present invention including, for example, photo paper, paper, card stock, business cards, fabric samples, carpet samples, synthetic membranes, acetate sheets, and the like. Furthermore, physical media may include any number of shapes and sizes without departing from the present invention.

Figure 4A:
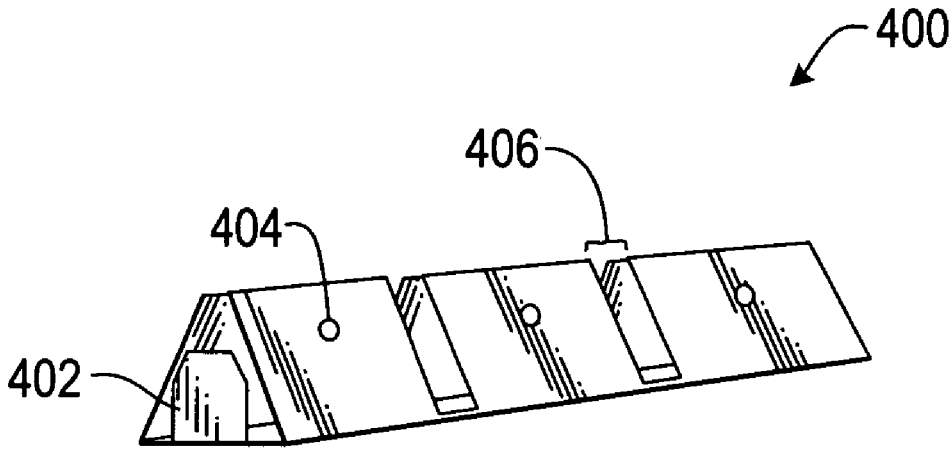
FIGS. 4*a-b* are illustrative representations of features of spine clamps in accordance with an embodiment of the present invention.
Figure 4B:
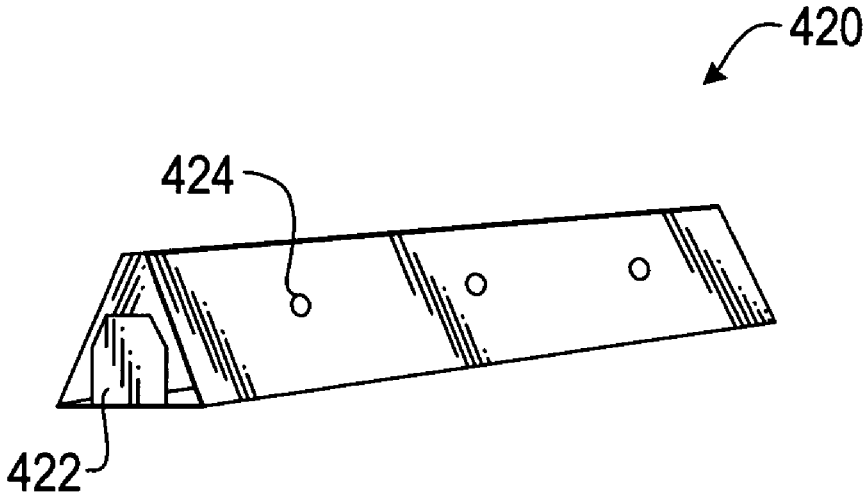
Figure 5:
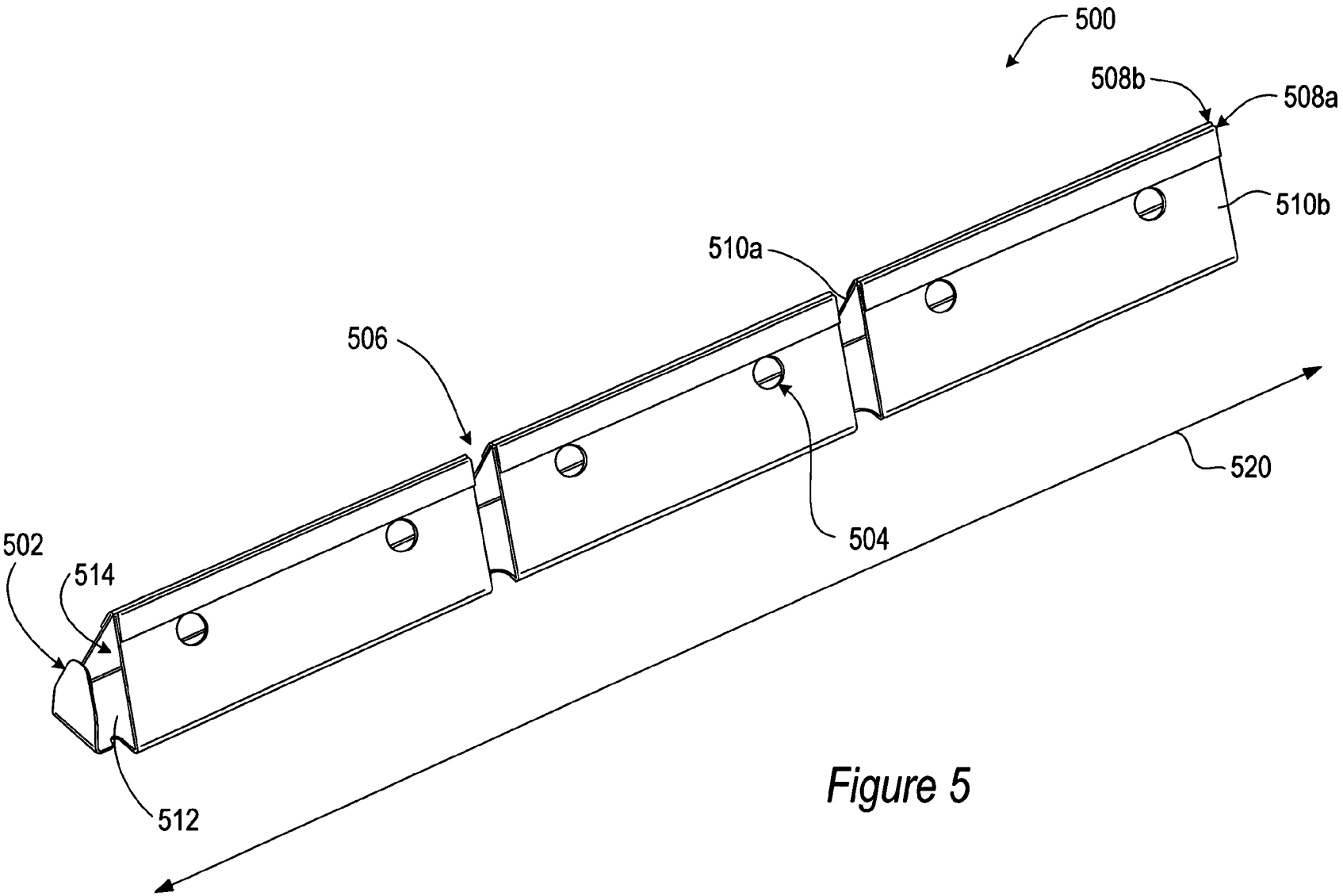
FIG. 5 is an illustrative representation of an orthogonal view of features of a spine clamp in accordance with an embodiment of the present invention.
Figure 6A:
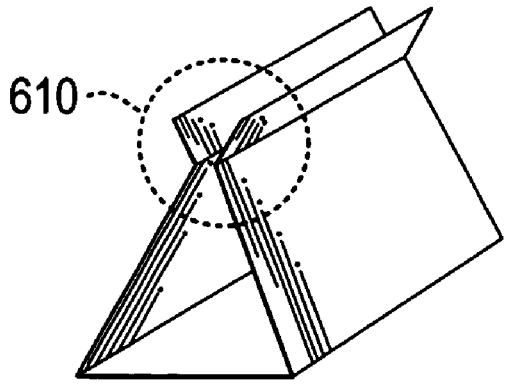
FIGS. 6*a-f* are illustrative representations of features of spine clamps having a variety of edge features in accordance with embodiments of the present invention.
Figure 6B:
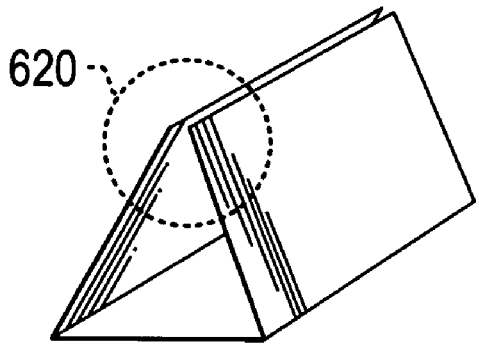
Figure 6C:
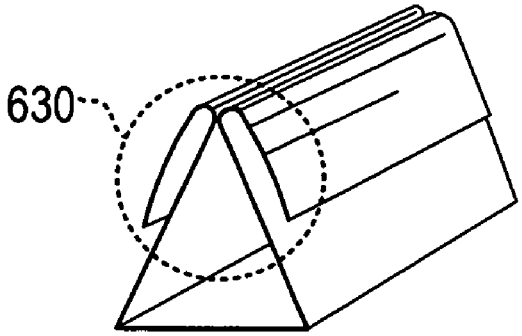
Figure 6D:
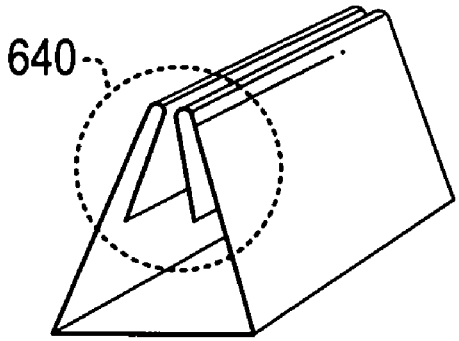
Figure 6E:
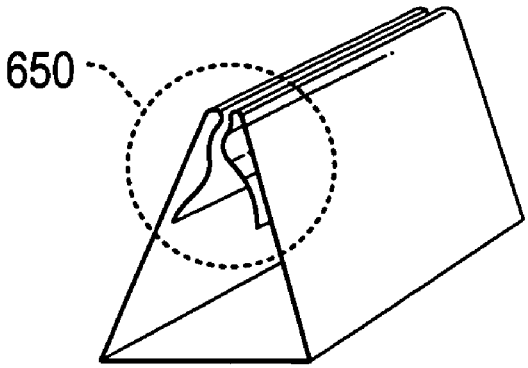
Figure 6F:
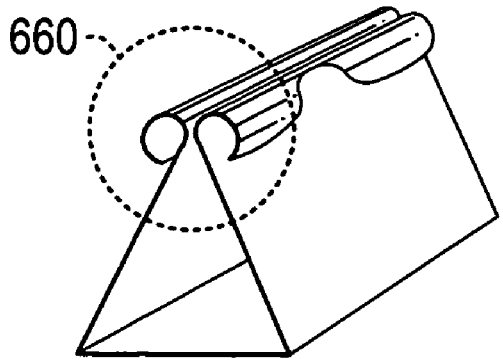

FIGS. 4*a-b* are illustrative representations of spine clamps, showing features of the invention, in accordance with an embodiment of the present invention. As noted above and as illustrated in FIG. 2*a*, one or more spine clamps may be utilized in embodiments of the present invention. In some embodiments, it may be desirable to utilize a single integrated spine clamp over several smaller spine clamps. In one embodiment including features of the present invention, robust clamping action is achieved through the utilization of a single integrated spine clamp. Thus, in FIG. 4*a*, a single spine clamp 400 is illustrated for use in some embodiments. Spine clamp 400 includes an integral datum stop 402 for providing an aligning mechanism as described above. Spine clamp 400 may further include a number of binding openings such as binding opening 404. As noted above, a tension sheet may be bonded to the spine clamp. In some embodiments, binding openings 404 may be utilized to open the spine clamp during construction and to insert a tension sheet. Binding openings 404 may also be optionally utilized to allow the binding glue to sip to the outside of the clamp face 510*b* thus strengthening the bonding of the tension sheet to the spine clamp. Tension sheets may be manufactured from a number of compositions including a substantially inelastic membrane, a substantially inelastic polymeric compound and a substantially inelastic fabric, or any other substantially inelastic composition without departing from the present invention. Further, binding openings may be shaped in any of number usable configurations such as, but not limited to, round as illustrated without departing from the present invention. As may be appreciated, binding may be accomplished in any manner well-known in the art without departing from the present invention including for example, gluing, bonding, welding, crimping, and any combinations thereof.

In some embodiments, spine clamp 400 may be partially segmented by gap 406. Segmentation, in some embodiments, may provide a more robust clamping force. A segmented design offers an advantage of more adequately securing physical media over different thicknesses because the segmentation provides independent clamping forces over the length of the physical media. In some embodiments, gaps are approximately 5 mm in width. Segmentation may additionally provide a safety mechanism. For example, segmentation may serve to reduce a force applied to a user if a finger or other appendage is inadvertently clamped.

In FIG. 4*b*, a single spine clamp 420 is illustrated for use in some embodiments having features of the invention. Spine clamp 420 includes an integral datum stop 422 for providing an aligning mechanism as described above. Spine clamp 420 may further include a number of binding openings such as binding opening 424. As noted above and described above, a tension sheet may be bonded to the spine clamp. As may be appreciated, binding may be accomplished in any manner well-known in the art without departing from the present invention including for example, gluing, bonding, welding, crimping, and any combinations thereof.

FIG. 5 is an illustrative representation of an orthogonal view of a spine clamp, showing features of the invention, in accordance with an embodiment of the present invention. A single spine clamp 500 is illustrated for use in some embodiments. In some embodiments, spine clamp 500 may be fashioned from a single sheet of material like, for example, spring steel. In other embodiments, spine clamp 500 may be fashioned from several pieces of materials which may be joined in any manner known in the art without departing from the present invention. Spine clamp 500 includes an integral datum stop 502 for providing an aligning mechanism as described above. Spine clamp 500 may further include a number of binding openings such as binding opening 504. As noted above, a tension sheet may be bonded to a spine clamp. As such, binding opening 504 may be utilized as described above. As may be appreciated, binding may be accomplished in any manner well-known in the art without departing from the present invention including for example, gluing, bonding, welding, crimping, and any combinations thereof. In some embodiments, spine clamp 500 may be partially segmented by gap 506. A segmented design offers an advantage of more adequately securing physical media over different thicknesses because the segmentation provides independent clamping forces over the length of the physical media. In some embodiments, gaps are approximately 5 mm in width. Segmentation may additionally provide a safety mechanism. For example, segmentation may serve to reduce a force applied to a user if a finger or other appendage is inadvertently clamped.

Spine clamp 500 further includes an opposing clamping edges 508*a* and 508*b*. As illustrated opposing clamping edges 508*a* and 508*b* are disposed parallel with axis 520. In some embodiments, opposing clamping edges 508*a* and 508*b* include an edge feature. Edge features will be discussed in further detail below for FIGS. 6 and 7. Opposing clamping edges are disposed along planar clamp faces 510*a* and 510*b* and are further disposed in parallel with axis 520. A clamp spring plate 512 joins planar clamp faces 510*a* and 510*b*. As illustrated, spine clamp 500 defines an interior cavity 514 for receiving physical media. Clamp spring plate 512 may be configured to provide a preload force and a clamping force. In one embodiment, clamp spring plate 512 may be configured to provide a preload force of approximately as described above. In other embodiments, clamp spring plate 512 may be configured to provide a clamping force of approximately as described above. To provide clamping forces, spine clamps may be manufactured from any of a number of compositions known in the art without departing from the present invention including spring steel, sheet metal, and a polymeric compound, or combinations thereof.

FIGS. 6*a-f* are illustrative representations of spine clamps having a variety of edge features in accordance with embodiments of the present invention. Edge features may be selected to accommodate any number of desired tension sheet attachment strategies. Thus, in one embodiment, an outwardly creased edge feature 610 (FIG. 6*a*) may be utilized. In another embodiment, a non-folded edge feature 620 (FIG. 6*b*) may be utilized. In another embodiment, an outwardly rolled edge feature 630 (FIG. 6*c*) may be utilized. In another embodiment, an inwardly rolled edge feature 640 (FIG. 6*d*) may be utilized. In another embodiment, an inwardly rolled profiled edge feature 650 (FIG. 6*e*) may be utilized. In another embodiment, an outwardly rounded edge feature 660 (FIG. 6*f*) may be utilized.

Figure 7A:
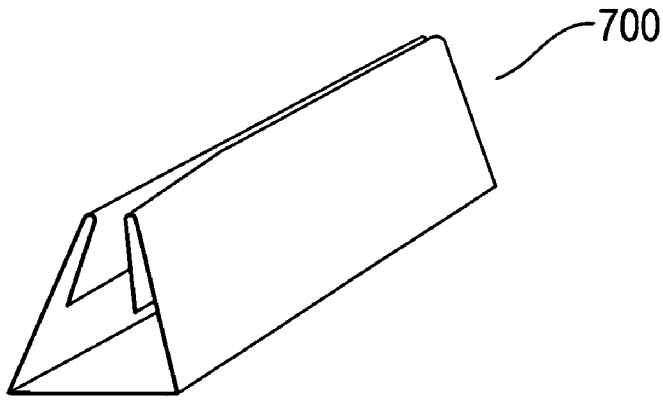
FIGS. 7*a-c* are illustrative representations of features of spine clamps having a variety of edge features in accordance with embodiments of the present invention.
Figure 7B:
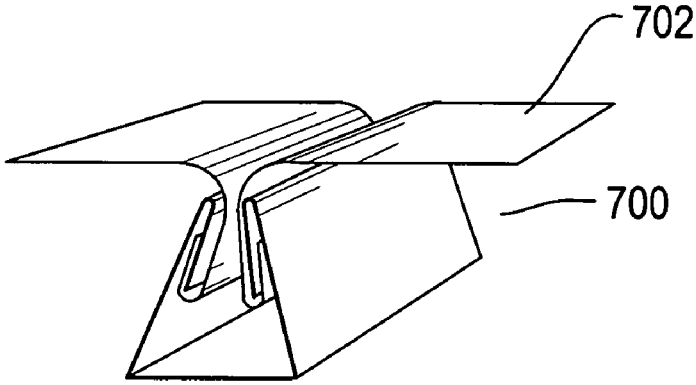
Figure 7C:
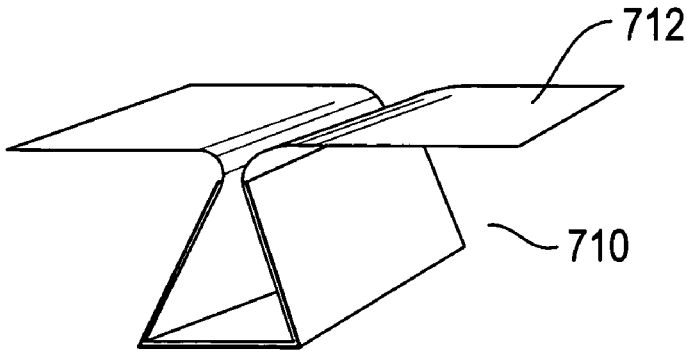

FIGS. 7*a-c* are illustrative representations of spine clamps having a variety of edge features showing features of the invention, in accordance with embodiments of the present invention. In particular, FIGS. 7*a-c* illustrate tension sheet configurations in accordance with embodiments of the present invention. Thus, in FIG. 7*a*, a spine clamp 700 illustrates an embodiment having an inwardly rolled edge feature. This feature in FIG. 7*a* provides for more easily sliding the tension sheet into position during construction of the binder. FIG. 7*b* illustrates an embodiment where spine clamp 700 is attached with tension sheet 702. As may be appreciated, attachment may be accomplished in any manner well-known in the art without departing from the present invention including for example, gluing, bonding, welding, crimping, and any combinations thereof. FIG. 7*c* illustrates an embodiment having a smooth edge feature where spine clamp 710 is bound with tension sheet 712. As noted above, binding may be accomplished in any manner well-known in the art without departing from the present invention including for example, gluing, bonding, and welding.

Figure 8A:
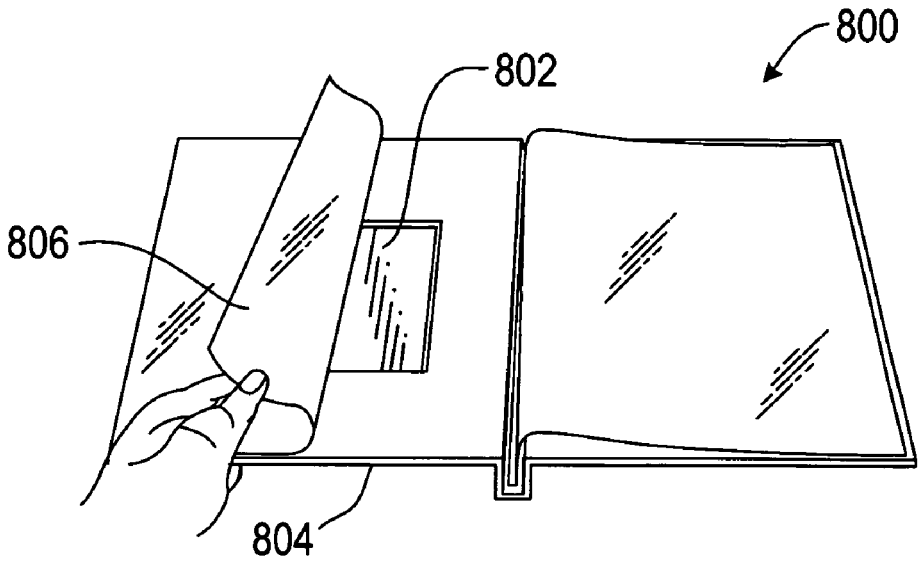
FIGS. 8*a-b* are illustrative representations of features of a media binder having various configurations in accordance with embodiments of the present invention.
Figure 8B:
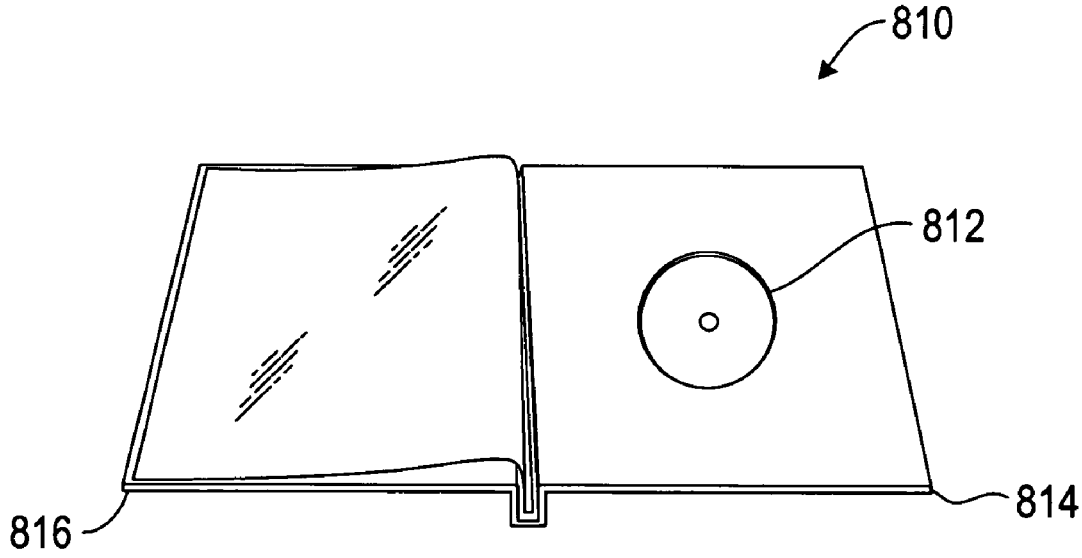

FIGS. 8*a-b* are illustrative representations of a media binder 800 and 810, showing features of the invention, having various configurations in accordance with embodiments of the present invention. Media binder 800 may be configured with a viewing port 802 for viewing a sample of physical media. Viewing port 802 may typically be disposed on front planar surface 804. Viewing ports may be constrained to any desired shape or size without departing from the present invention. An optional protective sleeve 806 may be utilized to hold and protect the sample of physical media. As may be appreciated, a viewing port may provide for ready identification of a particular media binder and may add desirable aesthetic appeal. FIG. 8*b* includes media binder 810 that includes a sleeve 812 for receiving substantially flat objects such as a CD for example. In one embodiment, the CD compartment may be integrated into the cover by, for example, configuring a cavity inside back planar surface 814 to accommodate for the thickness of the CD. In another embodiment, sleeve 812 may be affixed with back planar surface 814. In another embodiment, sleeve 812 may be affixed with front planar surface 816.

Figure 9A:
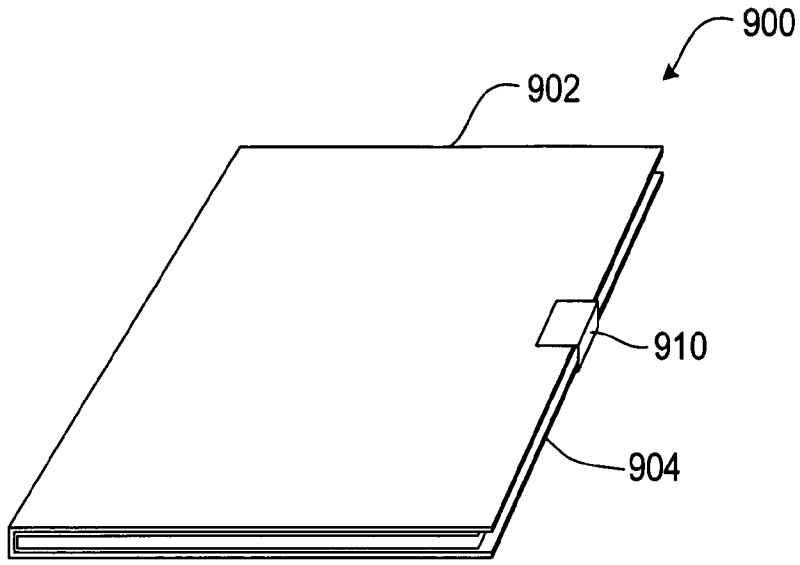
FIGS. 9*a-b* are illustrative representations of features of a media binder having a latch in accordance with embodiments of the present invention.
Figure 9B:
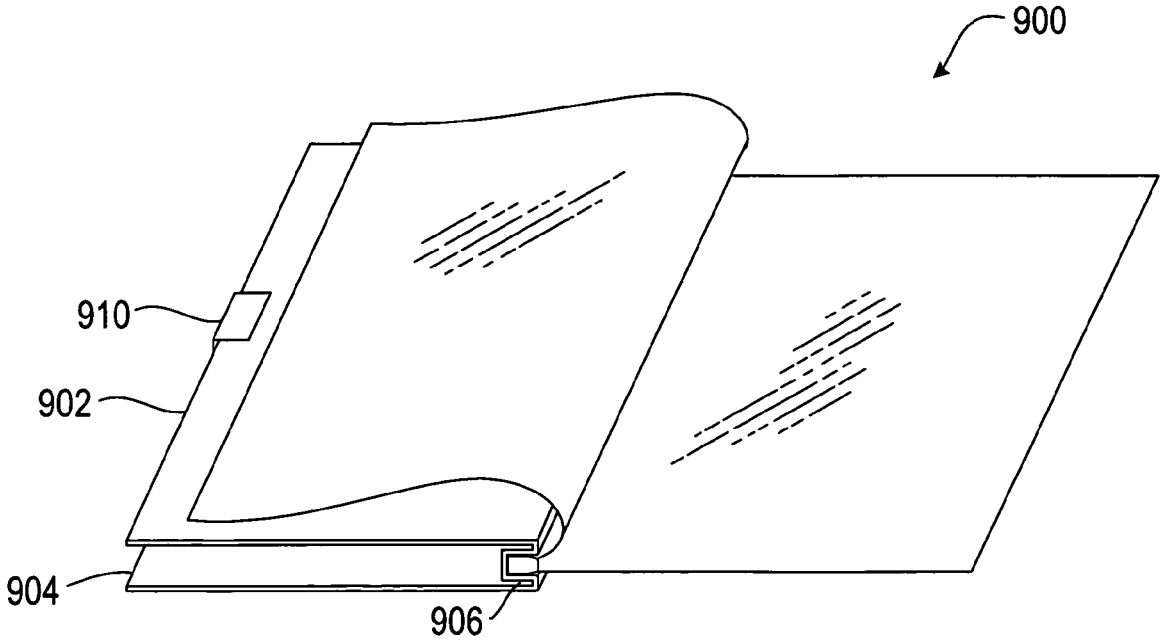

FIGS. 9*a-b* are illustrative representations of a media binder 900, having features of the invention, including a latch in accordance with embodiments of the present invention. FIG. 9*a* illustrates media binder 900 in a closed position with latch 910 engaged. Thus latch 910 may be utilized to removably secure front planar surface 902 with back planar surface 904. In some embodiments, a latch may be further configured to lock a media binder. FIG. 9*b* illustrates media binder 900 in a fully open position. In this position, spine clamp 906 is fully open to receive physical media. In one embodiment, latch 910 may be utilized to secure front planar surface 902 with back planar surface 904 so that spine clamp 906 may remain open. This configuration may provide ease of handling while securing physical media.

Figure 10:
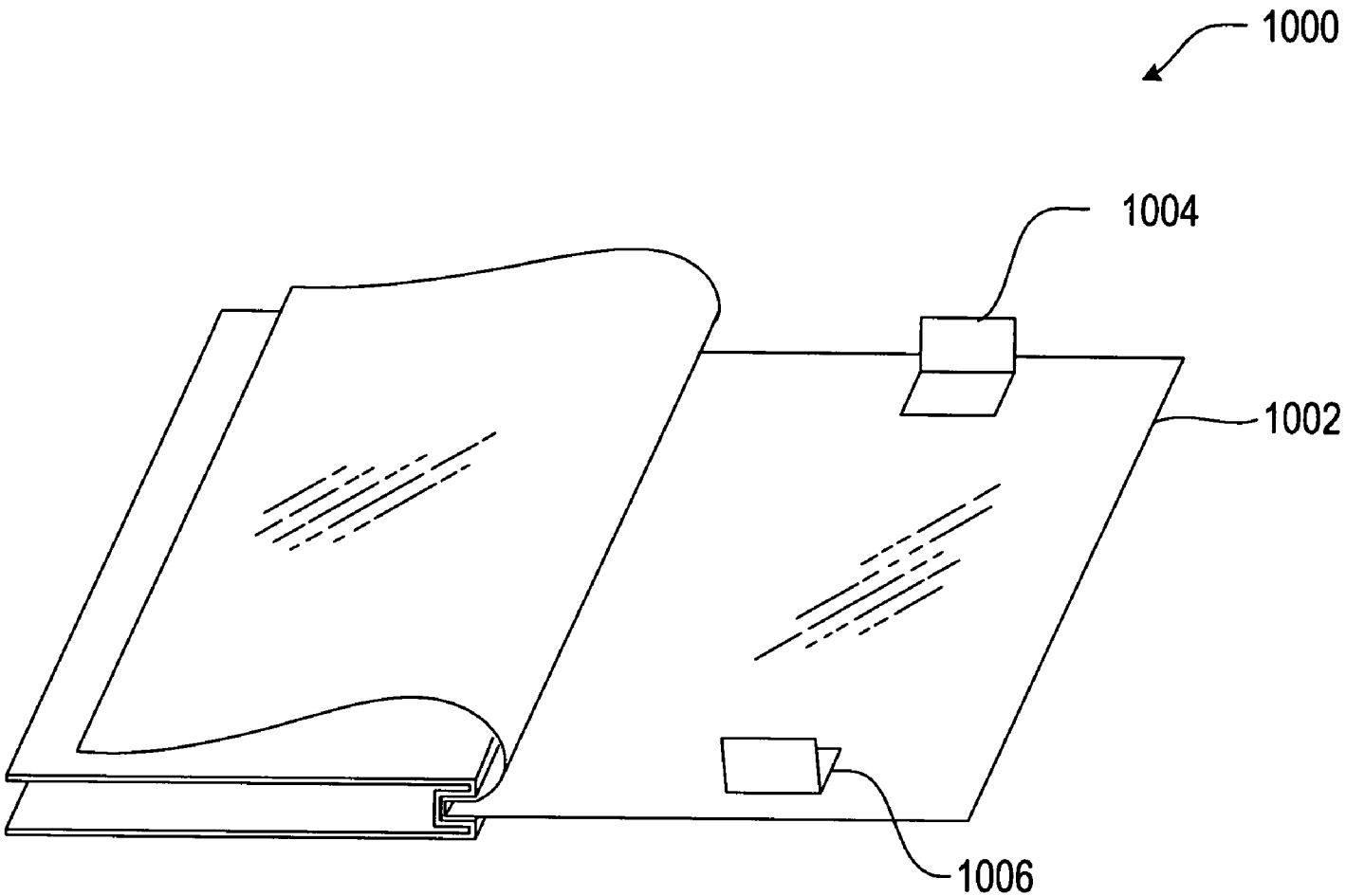
FIG. 10 is an illustrative representation of features of a media binder having alignment tabs in accordance with embodiments of the present invention.

FIG. 10 is an illustrative representation of a media binder 1000, having features of the invention, and including alignment tabs 1004 and 1006 in accordance with embodiments of the present invention. In some embodiments, as noted above, protective sheet 1002 may be utilized. In those embodiments, one or more alignment tabs 1004 and 1006 may be disposed to provide a convenient aligning mechanism for physical media. While a datum stop as described in embodiments above may be utilized for aligning, alignment tabs may provide for additional alignment options. Alignment tabs may be placed in any of a number of positions in accordance with user preferences without departing from the present invention.

While particular forms of the invention have been illustrated and described herein, it will be apparent that various modifications and improvements can be made to the invention. Moreover, individual features of embodiments of the invention may be shown in some drawings and not in others, but those skilled in the art will recognize that individual features of one embodiment of the invention can be combined with any or all the features of another embodiment. Further, the abstract is provided herein for convenience and should not be employed to construe or limit the overall invention, which is expressed in the claims. Accordingly, it is not intended that the invention be limited to the specific embodiments illustrated. It is intended that this invention to be defined by the scope of the appended claims as broadly as the prior art will permit.

What is claimed is:

1. A media binder, comprising:

a cover having a front, a back, and a spine, wherein the spine extends along a spine axis;

at least one spring clamp attached to the spine and defining an interior cavity operable to receive physical media, wherein each spring clamp comprises opposing inner clamp surfaces that face the interior cavity and respectively define respective opposing clamping edges that are operable to move resiliently toward and away from on another between a closed state and an open state and apply a clamping force therebetween, and the at least one spring clamp is biased to resist movement of the clamping edges into the open state;

at least one monolithic tension sheet, wherein each tension sheet is attached to the cover, extends from the cover, over at least one of the clamp edges, into the interior cavity, and over at least a portion of the respective inner clamp surface to which the tension sheet is attached, the at least one tension sheet being operable to transmit an opening force from the cover to the at least one spring clamp; and at least one datum stop each of which is coupled to the spine and disposed over the tension sheet such that the tension sheet is between the at least one spring clamp and the at least one datum stop, wherein each datum stop has a respective planar alignment surface in a plane that intersects and is orthogonal to the spine axis, wherein the alignment surface protrudes away from an inwardly facing side of the spine in a direction orthogonal to the spine axis and is exposed to engage at least one side edge of the physical media as the physical media is being inserted within the interior cavity.

2. The media binder of claim 1, wherein each spring clamp comprises a central portion that is coupled to the spine and is resiliently joined to two side portions that respectively define the opposing inner clamp surfaces.

3. The media binder of claim 2, wherein each of the side portions has at least one binding opening extending therethrough from the respective inner clamp surface to a respective outer clamp surface, and further comprising bonding material extending from the inner clamp surfaces, through the binding openings, to the respective outer clamp surfaces of the side portions.

4. The media binder of claim 2, wherein the at least one spring clamp is operable to apply between the clamping edges a clamping force in the range of 2 to 2.5 lbs. per linear inch of the spring clamp.

5. The media binder of claim 2 wherein the at least one spring clamp is operable to apply between the clamping edges a clamping force in the range of 2.5 to 3.5 lbs. per linear inch of the spring clamp.

6. The media binder of claim 2, wherein the at least one spring clamp is operable to apply between the clamping edges a clamping force in the range of 3.5 to 4.5 lbs. per linear inch of the spring clamp.

7. The media binder of claim 2, wherein the at least one spring clamp is operable to apply between the clamping edges a clamping force greater than 4.5 lbs. per linear inch of the spring clamp.

8. The media binder of claim 1, wherein the at least one spring clamp is operable to apply between the clamping edges a preload force of at least 0.1 lbs. per linear inch of the spring clamp.

9. The media binder of claim 1, further comprising a datum spacer extending through the interior cavity along the spine axis and having a planar datum surface that limits a depth to which the physical media is insertable within the interior cavity.

10. The media binder of claim 9, wherein the datum spacer has a thickness dimension that is orthogonal to the spine, and is approximately 1.5 mm.

11. The media binder of claim 9, wherein, within the interior cavity, the at least one tension sheet is disposed between the datum spacer and the at least one spring clamp.

12. The media binder of claim 1, further comprising a protective sheet having a front portion, a back portion, and a spine portion, wherein the spine portion of the protective sheet is constructed and arranged to be secured within the interior cavity by the at least one spring clamp, and the protective sheet further comprises a planar inner surface and at least one alignment tab protruding orthogonally from the planar inner surface and having a respective alignment surface that is exposed to engage at least one side edge of the physical media as the physical media is being inserted within the interior cavity.

13. The media binder of claim 1, wherein:

the front of the cover has a front planar surface, the back of the cover has a back planar surface, and the spine of the cover has a spine planar surface;

the front planar surface is disposed along and connected to the spine planar surface; and the back planar surface is disposed along and connected to the spine planar surface.

14. The media binder of claim 13, wherein the cover comprises a viewing port disposed through one of the front and the back, and further comprising a sleeve for holding a physical media sample such that the physical media sample is viewable through the viewing port.

15. The media binder of claim 1, further comprising:

a latch that is operable to fasten together the front and back of the cover in order to resist clamping force produced by the at least one spring clamp and secure the cover against closing when the cover is in an open configuration in which outer surfaces of the front and back of the cover are facing one another.

16. The media binder of claim 1, wherein the at least one tension sheet is configured to transmit the opening force when an angle of intersection between respective planar inner surfaces of the front and back of the cover is between 270° and 360°.

17. The media binder of claim 1, wherein the at least one spring clamp opens in response to application of the opening force in a range of 1 to 25 lbs.

18. The media binder of claim 1, wherein the tension sheet is manufactured from a composition selected from the group consisting of: a substantially inelastic polymeric compound, and a substantially inelastic fabric.

19. The media binder of claim 1, wherein the at least one spring clamp is manufactured from a composition selected from the group consisting of: spring steel, sheet metal, and a polymeric compound.

20. The media binder of claim 1, wherein the monolithic tension sheet has a central portion and first and second side portions, the central portion is attached within the interior cavity, the first and second side portions are respectively attached to the front and back of the cover, and the tension sheet is operable to transmit an opening force from the front and back of the cover to the at least one spring clamp.

21. The media binder of claim 20, wherein each spring clamp comprises a central portion that is coupled to the spine and resiliently joined to two side portions that respectively define the opposing inner clamp surfaces.

22. The media binder of claim 20, further comprising a latch that is operable to fasten together the front and back of the cover in order to resist clamping force produced by the at least one spring clamp and secure the cover against closing when the cover is in an open configuration in which outer surfaces of the front and back of the cover are facing one another.

23. The media binder of claim 20, wherein the tension sheet is manufactured from a composition selected from the group consisting of: a substantially inelastic polymeric compound, and a substantially inelastic fabric.

24. The media binder of claim 1, wherein the at least one tension sheet comprises a single monolithic sheet of inelastic material that comprises a central portion and first and second side portions, the central portion is within the interior cavity and the first and second side portions are respectively attached to the front of the cover and the back of the of the cover.

25. The media binder of claim 1, wherein each datum stop is positioned at a respective location that is outside the respective interior cavity defined by each spring clamp.

26. A media binder, comprising:

a cover having a front, a back, and a spine, wherein the spine extends along a spine axis;

at least one spring clamp attached to the spine and defining an interior cavity operable to receive physical media, wherein each spring clamp comprises opposing inner clamp surfaces that face the interior cavity and respectively define respective opposing clamping edges that are operable to move siliently toward and away from on another between a closed state and an open state and apply a clamping force therebetween, and the at least one spring clamp is biased to resist movement of the clamping edges into the open state;

at least one datum stop each of which is coupled to the spine, wherein each datum stop has a respective planar surface in a plane that intersects and is orthogonal to the spine axis, wherein the planar surface protrudes away from an inwardly facing side of the spine in a direction orthogonal to the spine axis and is exposed to engage at least one side edge of the physical media as the physical media is being inserted within the interior cavity; and a tension system coupled to the front of the cover, the back of the cover, and to the opposing clamp edges of the at least one spring clamp, wherein the tension system transmits an opening force from the cover to the at least one spring clamp in response to opening of the cover, wherein each of the at least one datum stop is disposed over the tension system such that the tension system is between the at least one spring clamp and the at least one datum stop.

27. The media binder of claim 26, wherein each spring clamp comprises a central portion that is coupled to the spine and is resiliently joined to two side portions that respectively define the opposing inner clamp surfaces.

28. The media binder of claim 27, wherein each of the side portions has at least one binding opening extending therethrough from the respective inner clamp surface to a respective outer clamp surface, and further comprising bonding material extending from the inner clamp surfaces, through the binding openings, to respective outer clamp surfaces of the side portions.

29. The media binder of claim 26, further comprising a protective sheet having a front portion, a back portion, and a spine portion, wherein the spine portion of the protective sheet is constructed and arranged to be secured within the interior cavity by the at least one spring clamp, and the protective sheet further comprises a planar inner surface and at least one alignment tab protruding orthogonally from the inner surface stop and having a respective planar surface that is exposed to engage at least one side edge of the physical media as the physical media is being inserted within the interior cavity.

30. The media binder of claim 29, wherein the protective sheet is selected from the group consisting of: a transparent film, a translucent film, an acetate film, a polymeric film, and vellum.

31. The media binder of claim 29, wherein the protective sheet is removably insertable into the at least one spring clamp.

32. The media binder of claim 26, wherein the tension system comprises a monolithic tension sheet that is attached to the cover, extends from the cover, over at least one of the clamp edges, into the interior cavity, and over at least a portion of the respective inner clamp surface to which the tension sheet is attached.

33. A media binder, comprising:

a cover having a front, a back, and a spine that extends along a spine axis;

at least one spring clamp attached to the spine and comprising at least two opposing clamping edges parallel to the spine axis and operable to move resiliently toward and away from on another between a closed state and an open state and apply a clamping force therebetween;

a tension system coupled to the front of the cover, the back of the cover, and to the opposing clamp edges of the at least one spring clamp, wherein the tension system transmits an opening force from the cover to the at least one spring clamp in response to opening of the cover; and at least one datum stop each of which is coupled to the spine and disposed over the tension system such that the tension system is between the at least one spring clamp and the at least one datum stop, wherein each datum stop has a respective planar surface in a plane that intersects and is orthogonal to the spine axis, wherein the planar surface protrudes away from an inwardly facing side of the spine in a direction orthogonal to the spine axis and is exposed to engage at least one side edge of physical media as the physical media is being inserted between the clamping edges.

34. The media binder of claim 33, wherein each of the clamping edges comprises a respective edge feature selected from the group consisting of: a non-folded edge, an inwardly rolled edge, an inwardly rolled profiled edge, an outwardly rolled edge, an outwardly rounded edge, and an outwardly creased edge.

35. The media binder of claim 33, wherein each spring clamp comprises a central portion that is coupled to the spine and is resiliently joined to two side portions that respectively define the opposing inner clamp surfaces, and each of the side portions has at least one binding opening extending from the respective inner clamp surface to a respective outer clamp surface, and further comprising bonding material extending from the inner clamp surfaces, through the binding openings, to respective outer clamp surfaces of the side portions.

36. The media binder of claim 33, wherein the at least one spring clamp is fashioned from at least one sheet of material.

37. The media binder of claim 36, wherein the at least one datum stop is fashioned from a second material and attached to the spring clamp.

38. A media binder, comprising:

a cover having a front, a back, and a spine that extends along a spine axis;

a spring clamp that is attached to the spine and defines an interior cavity operable to receive physical media, the spring clamp comprises opposing inner clamp surfaces that face the interior cavity and respectively define respective opposing clamping edges that are operable to move resiliently toward and away from on another between a closed state and an open state and apply a clamping force therebetween;

a datum stop that is coupled to the spine, wherein the datum stop has a planar surface in a plane that intersects and is orthogonal to the cover and the spine axis, wherein the planar surface protrudes away from an inwardly facing side of the spine in a direction orthogonal to the spine axis and is exposed to engage at least one side edge of physical media as the physical media is being inserted between the clamping edges; and a tension system having a central portion and first and second side portions, wherein the central portion is attached within the interior cavity, and each of the first and second side portions is attached to the cover, wherein the datum stop is disposed over the tension system such that the tension system is between the at least one spring clamp and the at least one datum stop.

39. The media binder of claim 38, wherein the spring clamp comprises a central portion that is coupled to the spine and resiliently joined to two side portions that respectively define the opposing inner clamp surfaces.

* * * * *

UNITED STATES PATENT AND TRADEMARK OFFICE

CERTIFICATE OF CORRECTION

PATENT NO. : 7,798,736 B2
APPLICATION NO. : 11/490687
DATED : September 21, 2010
INVENTOR(S) : Eric Hoarau et al.

It is certified that error appears in the above-identified patent and that said Letters Patent is hereby corrected as shown below:

In column 10, line 36, in Claim 24, after “back of the” delete “of the”.

In column 10, line 49, in Claim 26, delete “siliently” and insert -- resiliently --, therefor.

Signed and Sealed this
Fifteenth Day of March, 2011

David J. Kappos

David J. Kappos
*Director of the United States Patent and Trademark Office*